United States Patent [19]

Boyce

[11] Patent Number: 4,462,288

[45] Date of Patent: Jul. 31, 1984

[54] PUNCH PRESS APPARATUS FOR PERFORATING EXPLOSIVE SHEETS

[75] Inventor: Gary L. Boyce, Bel Air, Md.

[73] Assignee: The United States of America as represented by the Secretary of the Army, Washington, D.C.

[21] Appl. No.: 488,245

[22] Filed: Apr. 25, 1983

[51] Int. Cl.[3] ..... B26F 1/44

[52] U.S. Cl. ..... 83/128; 83/691; 83/925 R; 83/DIG. 1

[58] Field of Search ..... 83/123–128, 83/620, 691, DIG. 1, 925 R

[56] References Cited

U.S. PATENT DOCUMENTS

| | | | |
|---|---|---|---|
| 264,528 | 9/1982 | Hall | 83/123 |
| 896,478 | 8/1908 | Stockman | 83/128 |
| 2,619,897 | 12/1952 | Lawrence | 83/128 X |

*Primary Examiner*—James M. Meister

*Attorney, Agent, or Firm*—Anthony T. Lane; Robert P. Gibson; Harold H. Card, Jr.

[57] ABSTRACT

A punch press apparatus for perforating explosive sheet material has a cutter plate containing multiple tubular cutters projecting below the plate. Each cutter contains a spring biased plunger for ejecting cutout sheet material from within the tubular cutter. The rearward end of each plunger projects above the cutter plate and contains a compression spring which returns the plunger to its original position after it has ejected the cutout material. A removable plunger protector plate is positioned above the cutter plate and a plunger ejector plate is located above the protector plate. The latter contains holes for receiving the projecting plunger ends so that the plungers are not depressed when the ejector plate is moved downward to press the protector plate onto the cutter plate to perforate the sheet material against an anvil. After the perforation operation, the protector plate is removed and the ejector plate is moved downward to depress the plungers which eject the cutout sheet material from the cutters. A guide plate containing holes for receiving the projecting tubular cutters and positioned below the cutter plate, is moved downward to strip the perforated sheet from the outer surface of the tubular cutters.

4 Claims, 2 Drawing Figures

PUNCH PRESS APPARATUS FOR PERFORATING EXPLOSIVE SHEETS

GOVERNMENTAL INTEREST

The invention described herein may be manufactured, used and licensed by or for the Government for Governmental purposes without payment to me of any royalties thereon.

BACKGROUND OF THE INVENTION

This invention relates to a novel method and apparatus for perforating explosive sheets for use in line-wave generators. Explosive sheets generally contain a finely divided high explosive, such as pentaerythritoltetranitrate (PETN), cyclotrimethylenetrinitramine (RDX) and cyclotetramethylenetetranitramine (HMS), in a matrix of a binder such as a natural or synthetic resin, including rubber, polyurethane and epoxy resins, nitrocellulose or mixtures thereof. The particulate high explosive and liquid resin are blended into a homogeneous mass and the resulting product is formed into sheets, after which the resin is cured to produce the desired sheet product. Sheet explosives are well known in the art.

Perforated explosive sheets for line wave generators available commercially are generally of low quality in that the perforations are often not clean cut and the web is often torn, which can readily occur in view of the closeness of the perforations and the physical characteristics of explosive sheet materials.

SUMMARY OF THE INVENTION

In accordance with this invention there is provided a novel punch press apparatus for perforating explosive sheets which overcomes the aforementioned difficulties. The apparatus produces clean perforations and the quality of the in line wave generators produced therefrom is of high quality. The apparatus of this invention comprises a cutter plate containing multiple tubular cutters projecting below the plate, each cutter containing a resiliently biased plunger for ejecting cutout sheet material from within the cutter, the rearward end of the plunger projecting above said plate, a plunger protector plate removably positioned above the cutter plate and containing corresponding holes for receiving the projecting rear ends of said plungers;

a plunger ejector plate positioned above the protector plate for pressing the protector plate on the cutter plate to effect perforation of the sheet material, and for depressing the projecting plungers to eject the cutout sheet material from within the cutters when the protector plate is removed;

an anvil means for supporting the sheet material to be perforated; and a guide plate means containing corresponding holes for receiving the projecting cutters, for stripping the perforated sheet material from the outer surface of said cutters.

DETAILED DESCRIPTION OF THE INVENTION

Figure 1:
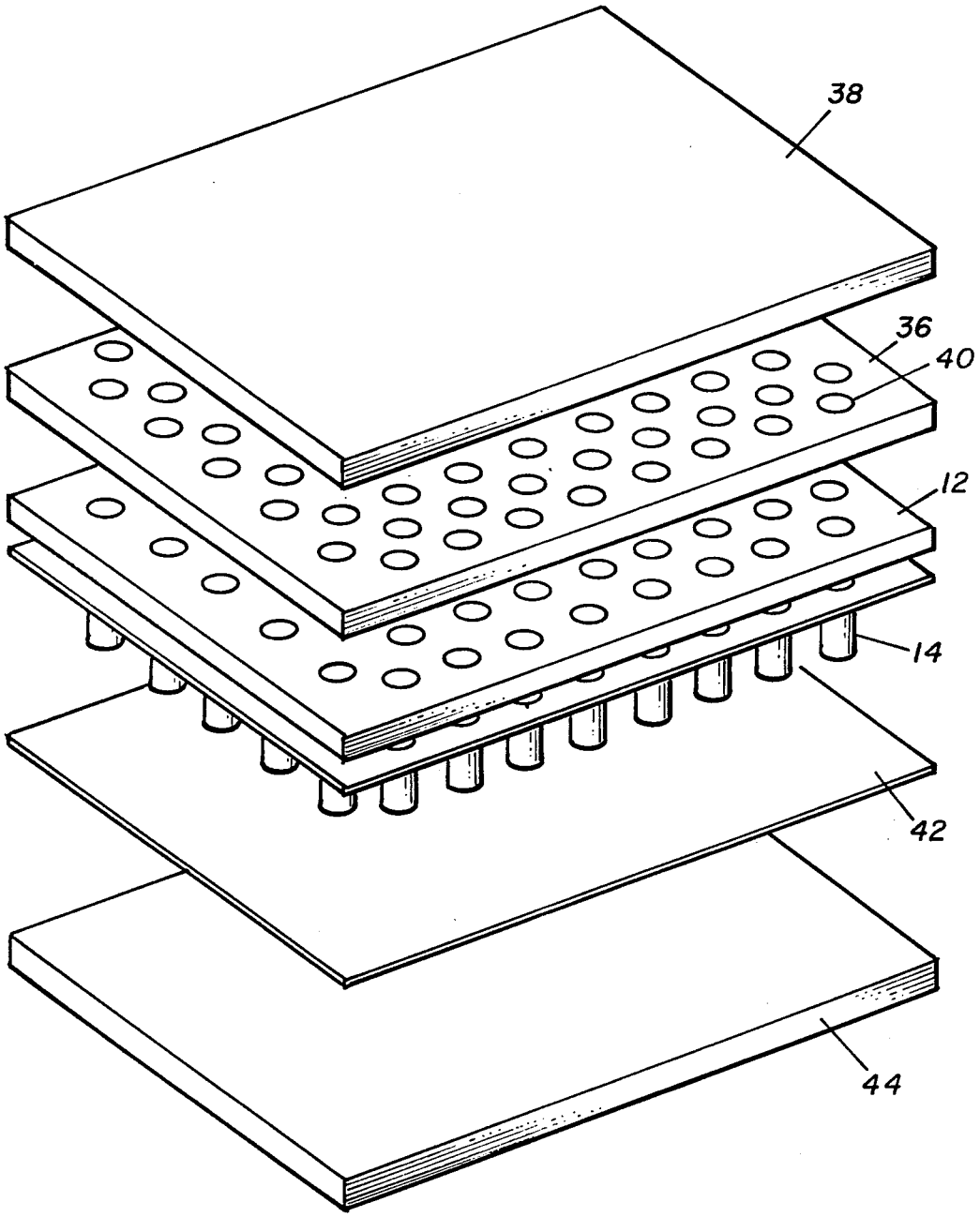
FIG. 1 shows an exploded view of the essential components of the punch press apparatus of the present invention for perforating explosive sheets.
Figure 2:
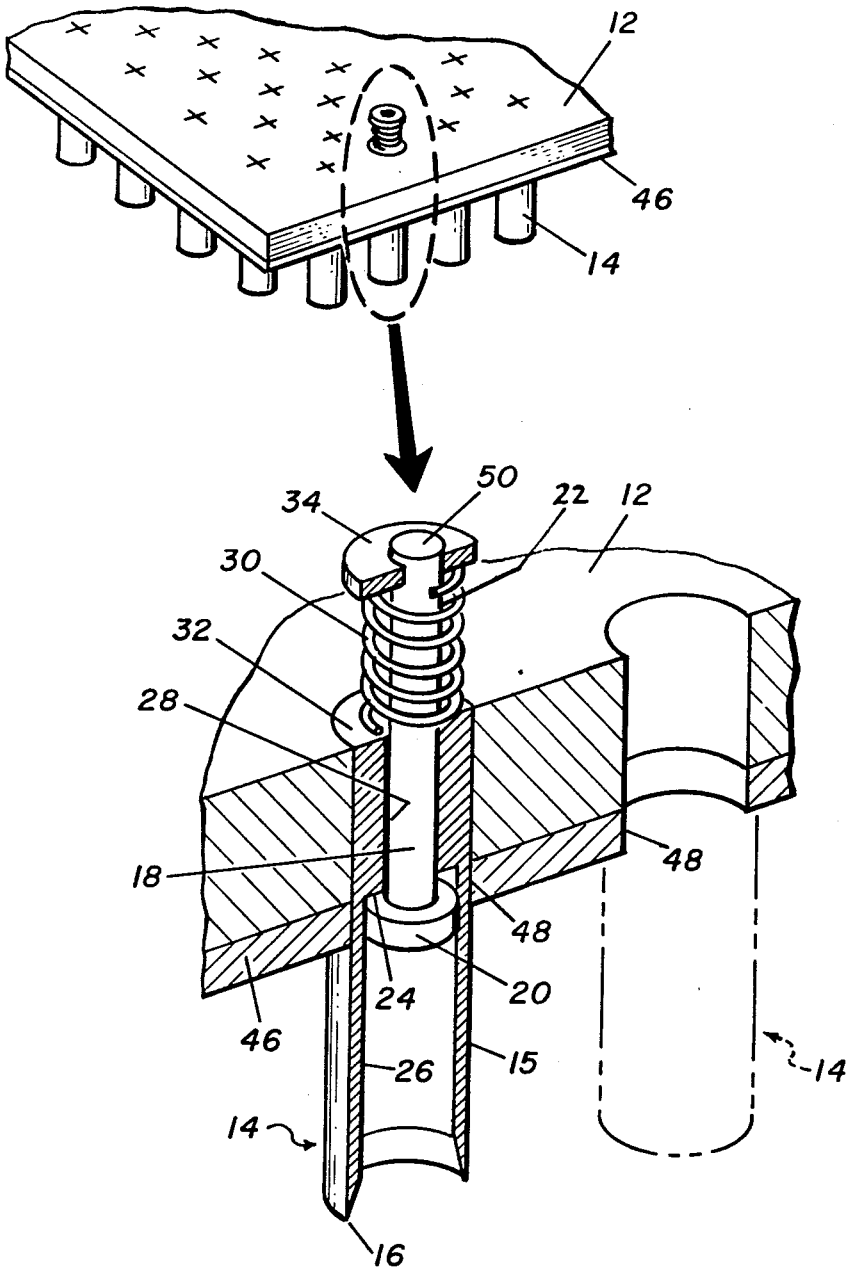
FIG. 2 shows an enlarged view of a single cutter assembly mounted in a gang cutter plate shown in FIG. 1.

With reference to the drawings, FIG. 1 illustrates an operating arrangement of the essential components of the novel punch press apparatus, wherein an aluminum cutter plate 12 contains multiple or gang steel cutters 14 affixed thereto. As shown in detail in FIG. 2, each cutter includes a cylindrical tubular body 15, which possesses an annular cutting edge 16 and is fixedly mounted in the cutter plate normal thereto. Within the tubular body is disposed a steel plunger 18 for ejecting cutout discs of sheet material from the cutter. The plunger is T-shaped in cross-section and has a circular head 20 and an elongated stem 22. As shown in FIG. 2, the circular head of the plunger rests on an annular shoulder 24 separating the wide lower bore 26 from the narrow upper bore 28 of the tubular cutter body 15, while the stem 22 projects above the cutter plate 12 and is held by a compression spring 30 disposed between the top 32 of the tubular cutter body and a retaining ring 34 attached to the rearward end of the plunger stem 22.

Above the gang cutter plate 12 is disposed an aluminum plunger protection plate 36, which is capable of contacting the cutter plate 12 without contacting or operating the plungers 18; and an aluminum plunger ejector plate 38 is positioned above the plunger protector plate 36. The protector plate 36 shown in FIG. 1 contains corresponding holes or bores 40 for receiving the plunger-spring assemblies projecting from the top of the cutter plate 12, the holes being of such depth as to prevent the plunger ejector plate 38 from contacting or operating the plungers 18 when the plunger ejector plate is pressed onto the superimposed protector and cutter plates to effect the perforation of the sheet material. When the plunger protector plate 36 is removed from between the cutter plate and the plunger ejector plate, the latter functions to depress the plungers 18 to eject the cutout discs from the cutters. The explosive sheet 42 is placed on a suitable acceptor board-anvil 44 positioned below the gang cutters 14. To aid the removal of the perforated sheet from the cutters 14, an aluminum guide plate 46 containing holes 48 for receiving the cutters is utilized. The guide plate is positioned below the cutter plate rearward of the cutting edge 16 of the cutters during the punching operation and is then moved downward to remove the perforated sheet from the outer surface the gang cutters.

The aforesaid components of the novel punch press apparatus are connected in conventional manner to means for mounting and operating same in the manner described above.

For safety reasons the operation of the apparatus for perforating explosive sheet material is conducted from a remote area. In operation, the first pressing, which effects the cutouts or perforations, is accomplished with the plunger protector plate 36 positioned between the plunger ejector plate 38 and the cutter plate 12. In the first pressing the plunger ejector plate 38 is moved downward and presses the protector plate 36 onto the cutter plate 12, causing the gang cutters 14 to punch perforations in the explosive sheet 42 supported on the acceptor board-anvil 44. The pressure is then released and the cutter plate is raised from the acceptor board-anvil. The plunger protector plate 36 is then moved laterally and removed from between the plates 12 and 38, and a second pressing is carried out by lowering the plunger ejector plate 38 onto the projecting plunger ends 50, thereby depressing the plungers 18 to eject the cutout discs of sheet material from the cutters. The ejector plate 38 is then raised to permit the plungers automatically to return to their original positions. The cutter plate is raised and the guide plate 46 is moved downward to strip the perforated sheet from the outer surface of the tubular cutters. The cycle can then be repeated.

For perforating explosive sheets for line wave generators of 0.040, 0.0675 and 0.125 inch thickness, a gang cutter plate was employed containing cylindrical cutters of $\frac{1}{4}$ inch diameter on 5/16 inch centers, so that the holes produced in the sheet material were 1/16 inch apart. The explosive sheet contained PETN (pentaerythritoltetranitrate) in a rubber matrix. The acceptor board anvil employed consisted of a slab of solid polyethylene and the pressing pressure was 300 psi. The perforations in the explosive sheet thus obtained were clean cut on both sides of the sheet, and there was no damage to the cutters or the explosive sheet. Despite the closeness of the perforations, the guide plate 46 permitted removal of the thin perforated explosive sheet from the gang cutters without tearing or damaging the web, which was not otherwise possible. Any solid material providing rigid support for the explosive sheet can be employed as the acceptor board-anvil. However, to minimize damage to the cutter blades and to provide firm, solid support to produce clean, sharp perforations, it is preferred to use an acceptor board anvil of non-metallic or non-ceramic materials, such as organic plastics including polyethylene and nylon, as well as wood.

It will be appreciated that the essential elements of the apparatus of the present invention can be connected in conventional manner to means for positioning and operating same in the desired manner described above. Further, various modifications may be made with respect to the preferred embodiment described above, such as the materials of construction, cutter dimensions, etc. Also, the novel apparatus can be employed for punching and perforating other explosive and non-explosive sheet materials, particularly thin sheets of organic plastic materials such as polyethylene, polypropylene, nylon, etc.

We claim:

1. A punch press apparatus for perforating explosive sheet material, which comprises in combination:

a cutter plate means containing multiple tubular cutters with annular cutting edges mounted therein, wherein each of said cutters projects below said plate and contains a plunger for ejecting cutout sheet material therefrom, said plunger comprising a forward end for ejecting said cutout material and a rearward end projecting above said cutter plate and containing a resilient biasing means for retracting said plunger;

a protector plate means removably disposed above said cutter plate, for contacting the cutter plate without operating said plungers;

a plunger ejection plate means disposed above said protector plate, for pressing said protector plate onto the cutter plate to effect perforation of the sheet material, and when said protector plate is removed, for depressing the plungers to eject the cutout sheet material from within said tubular cutters;

an anvil means for rigidly supporting the sheet material in the perforating operation; and a guide plate means for stripping the perforated sheet from the outer surface of the tubular cutters, said guide plate containing corresponding holes for receiving the projecting tubular cutters and being normally positioned between said cutter plate and said cutting edge.

2. An apparatus according to claim 1, wherein said resilient biasing means includes a compression spring mounted between the cutter plate and a retaining ring means affixed to the rearward end of said plunger.

3. An apparatus according to claim 2, wherein the plunger comprises a wide forward end and a relatively narrow, elongated rearward portion, said tubular cutter containing an annular shoulder for engaging said wide forward end.

4. An apparatus according to claim 2, wherein the protector plate contains corresponding holes for receiving the projecting plunger rear ends.

* * * * *